United States Patent [19]

Adams

[11] 3,951,412

[45] Apr. 20, 1976

[54] HORSE RACING BOARD GAME APPARATUS

[76] Inventor: Marshall C. Adams, 4016 W. Davison, Detroit, Mich. 48238

[22] Filed: Feb. 14, 1975

[21] Appl. No.: 550,126

[52] U.S. Cl. ..... 273/134 CH; 273/138 R; 273/145 B

[51] Int. Cl.[2] ..... A63F 3/00

[58] Field of Search ..... 273/86, 120, 121, 134, 273/138, 145

[56] References Cited

UNITED STATES PATENTS

| | | | |
|---|---|---|---|
| 1,104,069 | 7/1914 | Oliver | 273/138 R |
| 1,493,738 | 5/1924 | Cowan | 273/134 CH |
| 1,879,511 | 9/1932 | Rodgers | 273/138 R |
| 1,947,772 | 2/1934 | Harris | 273/138 R |
| 2,012,518 | 8/1935 | Orcutt et al. | 273/121 R |
| 2,241,567 | 5/1941 | Wobensmith | 273/145 B |
| 3,173,691 | 3/1965 | Kunneke | 273/120 R |
| 3,770,272 | 11/1973 | Olivier | 273/134 B X |
| 3,861,685 | 1/1975 | Trbovich | 273/138 R |

*Primary Examiner*—Delbert B. Lowe
*Attorney, Agent, or Firm*—Harness, Dickey & Pierce

[57] ABSTRACT

A horse racing game apparatus comprising a first section depicting a race course having a plurality of racing lanes each divided into a series of racing positions, a plurality of player manipulated pawns adapted to be selectively moved to successive positions along the lanes, a second section extending upwardly along the rearward side of the first section and having first and second pluralities of article receiving areas, an article adapted to be selectively placed in one of the areas of the first plurality thereof and thereafter be guided through a maze-like arrangement to the second plurality of areas, and instructions associated with each of the second plurality of areas for determining the particular position along the lanes to which the pawns are to be moved.

7 Claims, 5 Drawing Figures

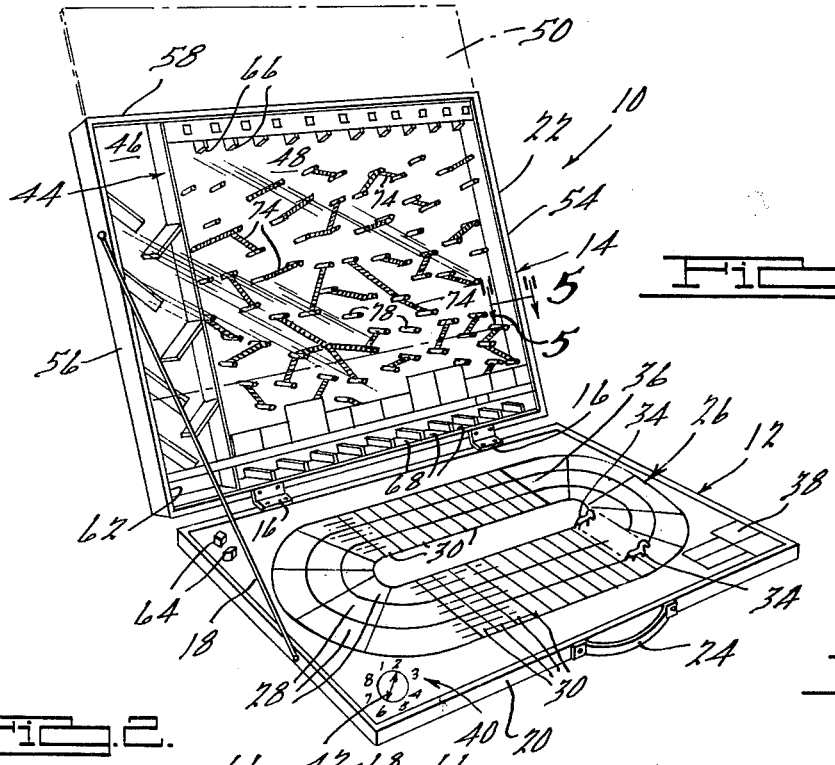
Fig. 1.
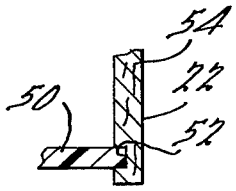
Fig. 5.
Fig. 2.
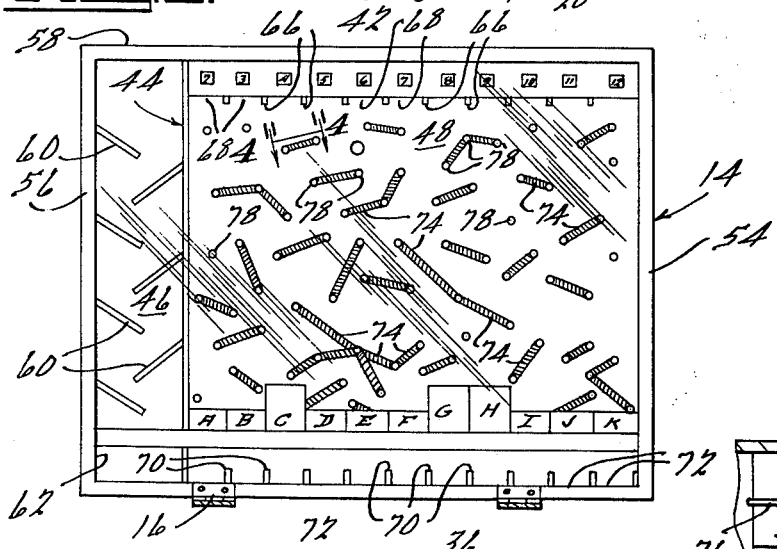
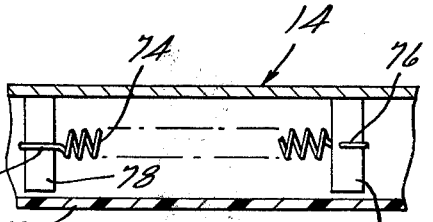
Fig. 4.
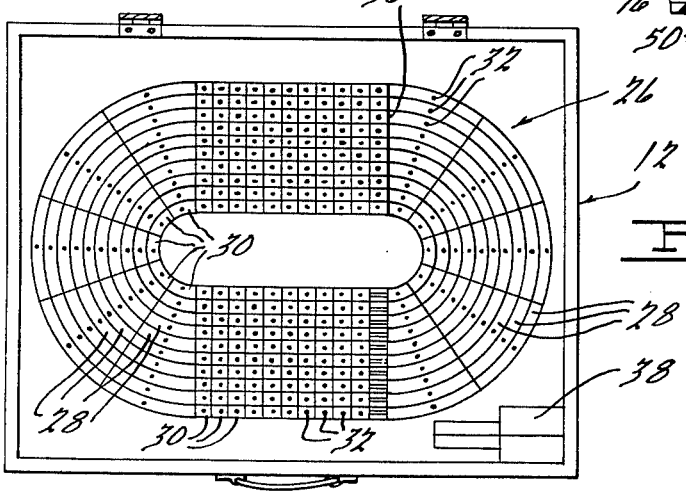
Fig. 3.

HORSE RACING BOARD GAME APPARATUS

SUMMARY OF THE INVENTION

The present invention is directed generally toward a horse racing game, and specifically, to a new and improved horse racing game which is designed to provide for extreme realism for the players so as to simulate to the greatest degree possible, the actual sense of excitement and anticipation experienced by those attending an actual horse race. More particularly, the present invention is directed to a horse racing game apparatus which includes a pair of hingedly connected game sections, namely, a first section depicting a horse race course which is provided with a plurality of concentrically oriented racing lanes, each of which is divided into sequentially arranged horse racing positions. The second section is disposed adjacent the rearward edge of the first section and extends generally vertically upwardly or upright therefrom. The second section is provided with a series of slots along the upper edge thereof into which an article may be dropped. Disposed below and extending along the lower edge of the second section is a series of recesses, each of which is provided with instructions which a player may use to determine to what position he should move his pawn along the race course depicted on the first section of the apparatus. Interposed between the plurality of slots and plurality of recesses is a maze-like area which, in the presently disclosed embodiment of the present invention, consists of a multiplicity of springs. During a particular player's turn, he will drop an article, such as a marble, ball bearing, etc., into one of the numbered slots, the particular number of which is determined by tossing one or more numbered dice. As the article drops downwardly from the particular slot into which it has been inserted, the article will follow a random path determined by the particular spring or springs against which the article impinges. Eventually, the article will fall into one of the recesses along the lower edge of the upright game apparatus section. The particular player will then note the instructions on or associated with this particular recess and he will move his pawn accordingly.

It is accordingly a general object of the present invention to provide a new and improved horse racing game apparatus.

It is a more particular object of the present invention to provide a horse racing game apparatus which may be played by a large number of different players.

It is yet another object of the present invention to provide a new and improved horse racing game apparatus in which the movement of the players' pawns is controlled entirely by chance and thus completely out of the influence of the players.

It is still another object of the present invention to provide a new and improved apparatus of the above-described type which is extremely portable and therefore may be conveniently moved from location to location in an effortless manner.

It is still a further object of the present invention to provide a new and improved horse racing game apparatus of the above type which is of a relatively simple construction and therefore can be economically manufactured and have a long and effective operational life.

Other objects and advantages of the present invention will become apparent from the following detailed description taken in conjunction with the accompanying drawing.

BRIEF DESCRIPTION OF THE DRAWING

FIG. 1 is an elevated perspective view of the horse racing game apparatus of the present invention;

FIG. 2 is a side elevational view of one section of the apparatus shown in FIG. 1;

FIG. 3 is a top elevational view of another section of the horse racing game apparatus shown in FIG. 1;

FIG. 4 is an enlarged fragmentary cross-sectional view taken substantially along the line 4—4 of FIG. 2; and FIG. 5 is an enlarged fragmentary cross-sectional view taken substantially along the line 5—5 of FIG. 1.

DESCRIPTION OF A PREFERRED EMBODIMENT

Referring now in detail to the drawing and in particular to FIG. 1 thereof, a horse racing game apparatus 10, in accordance with one preferred embodiment of the present invention, is shown as comprising lower and upper sections 12 and 14, respectively, which are pivotably or hingedly connected by means of suitable hinges 16. The sections 12, 14 are normally adapted to be stored and transported in a closed or face-to-face confronting relationship and at such time as it is desired to use the apparatus 10, the upper section 14 may be pivoted upwardly to a generally vertical position, as indicated in FIG. 1, with suitable pivot limiting means 18, such as a short chain, being provided for preventing excess pivotal movement of the upper section 14 relative to the lower section 12. Preferably, the apparatus 10 is utilized in a position wherein the lower section 12 is in a generally horizontal position, as illustrated. The sections 12, 14 are provided with relatively rigid rectangular-shaped frames 20 and 22, respectively, that are fabricated, for example, out of wood or similar material. A carrying handle 24 is provided on one of the sections 12, 14 and suitable latching means may be provided for retaining the sections 12, 14 in the closed position during storage and transport.

Referring now in detail to the lower section 12, as best seen in FIGS. 1 and 3, the upper side of the section 12, when the same is disposed in a generally horizontal position, depicts a horse race course, generally designated by the numeral 26 and consisting of a plurality of concentric horse racing lanes 28 which are divided into an equal number of horse racing positions, generally designated by the numeral 30. Each of the positions 30 along the lanes 28 is provided with a blind bore 32 which is adapted to receive a suitable downwardly projecting peg or the like of the player pawns which, as shown in FIG. 1, are depicted as miniature race horses 34. In playing the apparatus 10, each of the players is provided with a pawn 34 and these pawns are each assigned one of the lanes 28, with the pawns 34 being progressively moved around the lanes to selected positions 30 thereon in a manner hereinafter to be described. As each of the pawns 34 is moved to a new position 30 in its respective lane, the downwardly extending peg is inserted into the blind bore 32 at such position, whereby the pawn 34 will be maintained in a generally upright orientation on such position 30. The race course 26 is provided with an arbitrary "start" and "finish" line which is representatively designated by the numeral 36 in the drawings. It will be appreciated, of course, that separate lines can be used for the start and finish lines, although for purposes of simplicity of description, a common line 36 is used for both the start and finish lines. The lower section 12 is provided with an instruction area, representatively designated by the numeral 38, in which suitable written instructions may be provided to instruct the players as to the rules and procedures to be followed in playing the game, which procedures will hereinafter be described in detail. In addition, the lower section 12 of the apparatus 10 is provided with a numbered circle, representatively designated by the numeral 40, having a pivotable arrow or pointer 42 located centrally thereof. The pointer 42 is intended to be moved so as to be directed toward selected numerals, which numerals are representative of the particular player whose turn it is to move his respective pawn 34 during the game. As soon as a player has completed his turn, the pointer is moved to the next numeral indicating that the next numbered player is to have his turn, whereby to assure against one player taking more than his appropriate turn, or taking his turn out of sequence, etc.

Referring now in detail to the construction of the upper section 14 of the apparatus 10, as best seen in FIGS. 1 and 2, the section 14 includes a generally vertically disposed partition 44 which divides the section 14 into an elongated trough portion 46 and an article depositing portion 48. The portions 46, 48 are covered by a transparent cover, generally designated by the numeral 50, which is preferably, although not necessarily, fabricated of a suitable polymeric material such as Plexiglas and is adapted to be removably disposed within a pair of confronting tracks or slideways 52 formed in the opposite sides 54, 56 of the frame 22, whereby to permit removal of the cover 50 for purposes of cleaning and providing access to the interior of the upper section 14 of the apparatus 10. The upper end of the trough portion 46 is provided with an access opening 58 and is provided with a plurality of alternate downwardly inclined or angled baffles, generally designated by the numeral 60. The baffles are arranged in the trough portion 46 in a manner such that a pair of numbered dice may be dropped downwardly through the opening 58 and fall downwardly in a random manner toward the lower end of the trough portion 46. As shown in FIGS. 1 and 2, the lower end of the trough portion 46 is provided with an opening 62 through which the numbered dice may pass after they have dropped through the trough portion 46 and have been deflected therewithin by means of the baffles 60. A typical pair of numbered dice are shown in FIG. 1 and generally designated by the numeral 64. It is contemplated that the dice 64 be six-sided and each side thereof be provided with suitable indicia, such as spots, dots, etc., ranging from one through six.

The article depositing portion 48 of the upper section 14 of the apparatus 10 is provided with a series of vertically extending horizontally spaced partitions 66 which define a plurality of slots or access openings 68 therebetween. The slots 68 are open at the upper ends thereof and are numbered from 2 through 12, as indicated in FIGS. 1 and 2. A similar number of partitions, generally designated by the numeral 70, are disposed adjacent the lowermost part of the upper section 14. The partitions 70 define a plurality of access openings 72 located below the cover 50, and the openings 72 are representatively designated by the letters A through K on the upper section 14. Each of the letters A through K is representative of player instructions, such as indicated below:

A. Advance 3 spaces.
B. Broke stride—Advance 1 space only.
C. Boxed in to immediate left (If no horse in same section, then advance 4 spaces).
D. Advance 10 spaces.
E. Rider using crop—Drop back 2 spaces.
F. Broke stride—Advance 1 space only.
G. Boxed in to immediate right (If no horse in same section, then advance 4 spaces).
H. Free from being boxed in—Advance 6 spaces (If boxed in, then do not advance).
I. Advance 5 spaces.
J. Rider using crop—Drop back 2 spaces.
K. Advance 4 spaces.

It will be appreciated that the instructions A through K may be placed directly above each of the openings 72, or alternatively, the players may be given instruction cards indicating the specific instructions associated with each of the openings 72.

In accordance with one of the principles of the present invention, disposed on the underside of the cover 50, between the slots 68 and openings 72, is a plurality of randomly arranged helical coil springs, generally designated by the numeral 74. The plurality of springs 74 are arranged in an imaginary plane that is located parallel to the cover 50, as best seen in FIG. 4, with the various springs 74 having end portions 76 that are adapted to be supported upon outwardly extending posts, generally designated by the numeral 78. The orientation of the posts 78 and springs 74 is intended to be entirely random within the section 14 of the apparatus 10, with some of the springs 74 being generally colinearly arranged, and others being arranged at an angle to one another so as to provide a maze or series of tortuous paths along which an article dropped into one of the slots 68 may follow as such article moves toward one of the openings 72. The purpose of the plurality of springs 74 is to provide, to the greatest degree possible, a means by which to cause the article, such as marble, ball bearing or the like, to follow an entirely unanticipated or unexpected and uncontrolled path to one of the openings 72. In order to further cause such articles to move along an unexpected and random path, a plurality of additional posts 78 may be provided among the springs 74 for further deflecting such article as it moves downwardly toward the openings 72.

Referring now in detail to the overall operation of the apparatus 10 of the present invention, assuming that each of the players has been assigned a number and is provided with a pawn 34, and that the pawns 35 are suitably lined up one in each of the lanes 28 along the starting line 36, each player in turn tosses the dice 64 and the players move their respective pawns 34 a number of positions 30 along their racing lanes in accordance with the number of "spots" or other indicia on the dice 64; i.e., 6 spots results in moving a pawn 6 positions forward. As each player has his turn, the pointer 42 is rotated so that it is directed toward the numeral of the respective player. After each player has completed his first turn, the first player will drop the dice 64 into the open upper end 58 of the trough portion 46, whereupon the dice 64 will drop downwardly between and among the angled baffles 60 and fall out of the upper section 14 through the access opening 62. This player will then note the number of indicia, spots, etc., on the dice and he will then place the aforementioned article, i.e., marble, etc., (not shown) in the opening 68 corresponding to the sum of total of the spots on the upper sides of the dice 64. For example, if the dice fall out of the access opening 62 such that one die 64 has two spots on the upper side thereof and the other die 64 has five spots on the upper side thereof, the player will insert the marble through the slot numbered 7. The marble will then drop downwardly among the plurality of springs 74 and will be deflected in a random uncontrolled and unexpected path toward the lowermost part of the upper section 14 and the marble will eventually fall into one of the recesses 72 defined between the partitions 70. For example, the marble might fall into the recess identified by the letter G. The player will then move his particular pawn 34 in accordance with the instructions associated with the letter G, as hereinabove described. Following the appropriate movement of the first player's pawn, the pointer 42 may be pivoted so as to register with the next numbered player and this player will then drop the dice 64 into the trough portion 46, and follow the exact procedure followed by the preceding player. This process will continue until each of the players has had his respective turn, with each of the pawns 34 being moved in accordance with the instructions of the particular opening 72 into which the article falls. After each player has completed his turn, the process continues with the first player again taking his next turn, etc. The players will continue taking their respective turns until such time as three of the players' pawns 34 transverse the entire horse racing course 26 and cross the finish line 36, at which time the players will ascertain the relative positions of their respective pawns 34 to determine the relative "standing" of the various players, i.e., first place, second place, third place, etc., or "win", "place" and "show". It will be appreciated, of course, that instead of making a single revolution around the race course 26, it may be agreed ahead of time to traverse two, three or more times therearound, depending upon the time available for playing the game.

It will also be appreciated that the realism of the game may be enhanced by placing odds upon the respective players and their pawns 34, whereby the players may make wagers amongst themselves as to the probability and likelihood of one player finishing ahead of another player thereof, with the winning player, i.e., the player who moves his pawn 34 across the finish line first being entitled to some pre-arranged share of any monies which are wagered, and the players who merely "place" or "show" being entitled to proportionate amounts.

While it will be apparent that the preferred embodiment illustrated herein is well calculated to fulfill the objects above stated, it will be appreciated that the present invention is susceptible to modification, variation and change without departing from the scope of the invenetion.

I claim:

1. A horse racing game apparatus comprising, a first section depicting a race course having a plurality of racing lanes each divided into a series of racing positions, a plurality of player manipulated pawns adapted to be selectively moved to successive positions along said lanes, a second section having first and second pluralities of article receiving areas, at least one article adapted to be placed in one of said areas of said first plurality thereof and means for guiding said article for movement from said first plurality of areas to said second plurality of areas, said last mentioned means comprising deflector means for selectively randomly deflecting said article as the same moves from said first plurality of areas to said second plurality of areas, chance means for determining the particular area of said first plurality thereof into which said article is to be placed, and means associated one with each of said areas of said second plurality thereof and into which said article is to be received for determining the particular position along said lanes to which said pawns are to be moved.

2. The invention as set forth in claim 1 wherein said chance means comprises at least one numbered die.

3. The invention as set forth in claim 1 wherein said deflector means comprises spring means against which said article is adapted to engage for causing random movement thereof from said first plurality of areas to said second plurality of areas.

4. The invention as set forth in claim 1 wherein said lanes are concentrically oriented.

5. The invention as set forth in claim 2 which includes a tortuous path along which said die may traverse.

6. The invention as set forth in claim 1 wherein said first section of said apparatus is generally horizontally oriented and said second section extends in a generally vertical or upright position adjacent said first section.

7. The invention as set forth in claim 6 wherein said second section includes a plurality of slots along the upper edge thereof constituting said first plurality of areas, and a plurality of recesses along the lower edge of said second section constituting said second plurality of areas, said deflector means comprising a multiplicity of springs located at vertically and horizontally spaced positions between said slots and said recesses, a transparent cover for said second section, and an elongated trough defining a tortuous path and arranged along one edge of said second section into which a numbered die may be inserted.

* * * * *